US006957604B1

(12) United States Patent
Tiedemann et al.

(10) Patent No.: US 6,957,604 B1
(45) Date of Patent: Oct. 25, 2005

(54) AXIAL-PISTON DRIVE SYSTEM WITH A CONTINUOUSLY ADJUSTABLE PISTON STROKE

(75) Inventors: Thomas Tiedemann, Ludwigsburg (DE); Otfried Schwarzkopf, Magstadt (DE)

(73) Assignee: Zexel GmbH, Weiterstadt (DE)

( * ) Notice: Subject to any disclaimer, the term of this patent is extended or adjusted under 35 U.S.C. 154(b) by 527 days.

(21) Appl. No.: 10/049,690

(22) PCT Filed: Aug. 18, 2000

(86) PCT No.: PCT/EP00/08084

§ 371 (c)(1),
(2), (4) Date: Jun. 18, 2002

(87) PCT Pub. No.: WO01/12989

PCT Pub. Date: Feb. 22, 2001

(30) Foreign Application Priority Data

Aug. 18, 1999 (DE) ..... 199 39 131

(51) Int. Cl.[7] ..... F15B 15/22; F04B 1/26

(52) U.S. Cl. ..... 91/506; 417/222.1; 417/270; 417/313

(58) Field of Search ..... 91/506; 417/506, 417/222, 222.1, 222.2, 212, 220, 269, 270, 417/313

(56) References Cited

U.S. PATENT DOCUMENTS

| | | | | |
|---|---|---|---|---|
| 2,964,234 | A * | 12/1960 | Loomis, III | 230/20 |
| 3,552,886 | A * | 1/1971 | Olson, Jr. | 417/269 |
| 4,037,993 | A * | 7/1977 | Roberts | 417/22 |
| 4,073,603 | A * | 2/1978 | Abendschein et al. | 417/222 |
| 4,475,871 | A * | 10/1984 | Roberts | 417/22 |
| 5,226,349 | A * | 7/1993 | Alme et al. | 91/506 |
| 5,295,796 | A * | 3/1994 | Goto et al. | 417/22.1 |

* cited by examiner

*Primary Examiner*—Charles G. Freay
(74) *Attorney, Agent, or Firm*—Andrus, Sceales, Starke & Sawall, LLP

(57) ABSTRACT

The invention relates to an axial piston drive with a continuously adjustable piston stroke, which comprises a drive shaft (10, 12) on which a swash plate (16) is supported in a crank chamber (14) in such a way as to be tiltable and displaceable in the axial direction, as well as a controller (18, 20) by means of which an tilt angle and an axial position of the swash plate (16) can be adjusted, and at least one piston (26, 28) connected to the swash plate (16) so that it can be actuated to move within a cylinder (22, 24).

11 Claims, 3 Drawing Sheets

AXIAL-PISTON DRIVE SYSTEM WITH A CONTINUOUSLY ADJUSTABLE PISTON STROKE

CROSS REFERENCE TO RELATED APPLICATION

Figure 1:
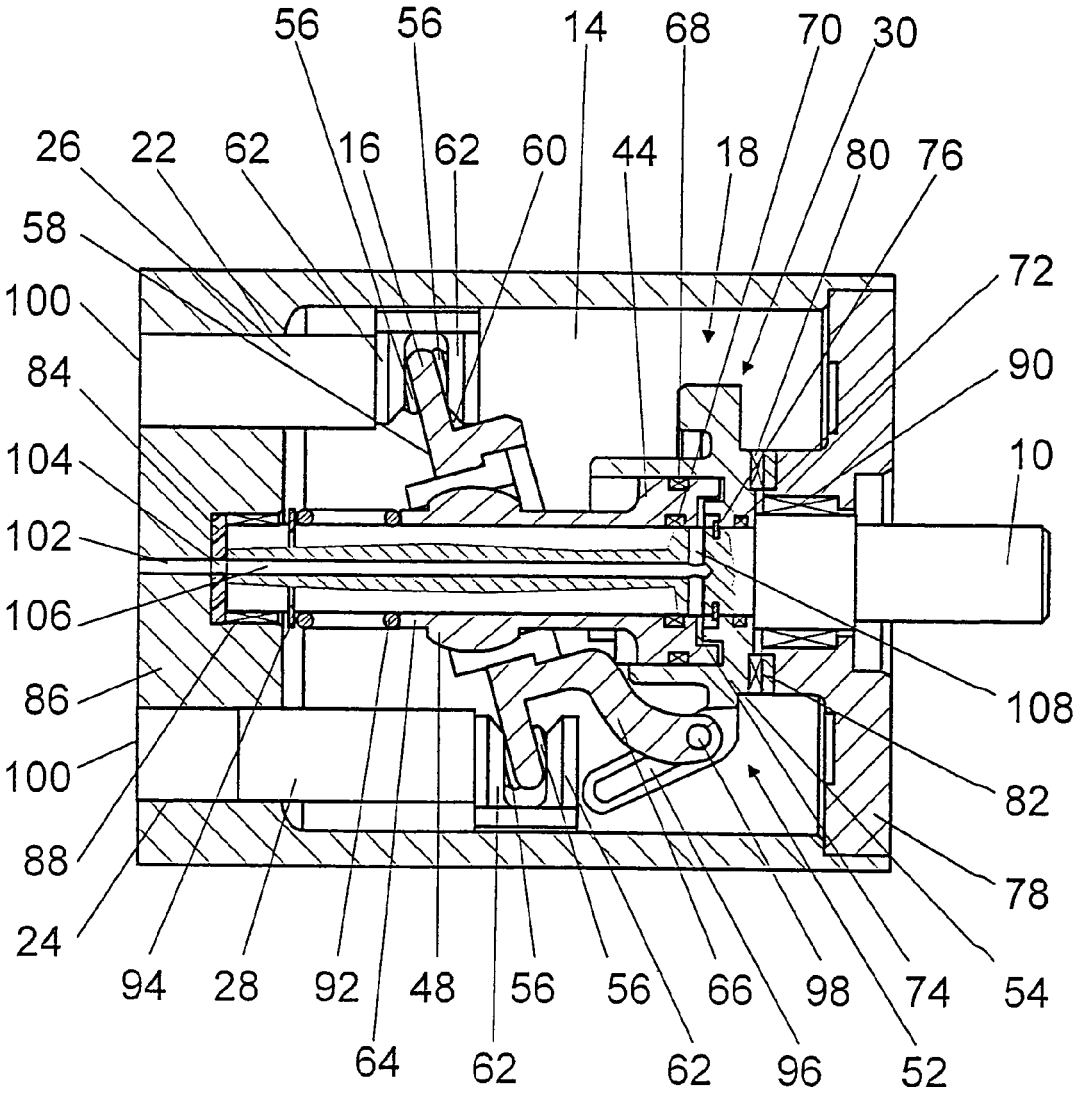

The present application is the U.S. national stage application of International Application PCT/EP00/08084, filed Aug. 18, 2000, which international application was published on Feb. 22, 2001 as International Publication WO 01/12989 A1 in the German language. The International Application claims priority of German Patent Application 199 39 131.9, filed Aug. 18, 1999.

STATE OF THE ART

The invention relates to an axial piston drive with a continuously adjustable piston stroke.

The use of axial piston drive with a continuously adjustable piston stroke is known in particular for motor-vehicle air conditioners, where they serve as coolant condensers.

The main components of an air conditioner for a motor vehicle are a coolant condenser, a first heat exchanger, the so-called evaporator, a second heat exchanger, an expansion organ and conduits that connect the components to one another. The role of the coolant condenser is to suck a coolant out of the evaporator, in which the coolant evaporates under heat absorption, and to condense it at a higher pressure level. Subsequently, in the second heat exchanger, the coolant can release the heat at a higher temperature level, and in the expansion organ it is returned to a pressure level corresponding to that of the evaporator.

The output of the coolant condenser can be continuously adjusted by way of the speed of a drive motor and in an especially energetically favourable manner, in the case of axial piston drives, by way of the piston stroke. Known axial piston drives or axial piston condensers for vehicle air conditioners comprise a drive shaft operated by way of a pulley. Within a crank chamber a swash plate is supported on the drive shaft so that it is unrotatably fixed and can be tilted by way of a joint. The swash plate drives at least one piston that can move within a cylinder. In order to absorb tractive and pressure loads, each such piston is connected to the swash plate by way of two hinge yokes, one at the bearing surface of the swash plate that faces the piston and the other at the surface that faces away. With their flat surfaces contacting the bearing surfaces of the swash plate, the hinge yokes run at full circumferential velocity with a superimposed radial movement, which results in an elliptical path. The hinge yokes are seated with their rounded surfaces in sphere shaped formed bearings of the pistons, within which there is comparatively little relative movement during operation.

Furthermore, the connection between the swash plate and the piston can be formed by way of a wobble plate rather than hinge yokes as described above. The wobble plate is secured against rotation with respect to the drive shaft by either a housing or piston rods. A bearing between the swash plate and the wobble plate absorbs the entire relative movement. The wobble plate performs only a wobbling movement as a result of the rotation of the swash plate.

The piston stroke and hence the output of the axial piston drive unit is adjusted by altering the tilt angle of the swash plate. A large tilt angle results in a long piston stroke and high output, whereas with a small tilt angle the piston stroke is shorter and the output lower. As a rule, the tilt angle of the swash plate is limited to a minimal and a maximal value by two stops. Ordinarily one or two guide pins are needed to guide the tilting movement in a specified manner and to avoid jamming. The tilt limiters, i.e. the stops, can be integrated into the guide pins.

If, as a result of adjustment of the tilt angle from a maximal value to a smaller one, a top-dead-centre point of the piston within the cylinder is shifted in the direction of the swash plate, already compressed gas cannot be completely expelled. The compression energy introduced into the gas cannot be utilized for the cooling process. The result is a "damage space" between the piston and a valve plate on the cylinder, which causes a loss of energy. In order to avoid the damage space and to keep the top-dead-centre point of the piston in a constant position, the swash plate is supported so that it can additionally be axially displaced against a prestressed compression spring. The movement of the swash plate in the axial direction is usually limited by stops.

ADVANTAGES OF THE INVENTION

The axial piston drive in accordance with the invention comprises a drive shaft with a swash plate supported thereon within a crank chamber so as to be tiltable and displaceable in the axial direction. A tilt angle and an axial position of the swash plate can be adjusted by a controller. The driving action of the swash plate is exerted by connection to at least one piston that can move within a cylinder.

It is proposed that the controller comprise an adjustment unit separate from the piston. With such a separate adjustment unit it is possible to obtain a large range of control that is independent of the operating points. A controlling torgue can be applied exclusively in the direction of the possible adjustment movement of the swash plate, which enables jamming and increased wear and tear to be avoided.

Flow losses between the upper side of the piston and the crank chamber can also be avoided and the full output of the condenser can be exploited, for example for cooling an air conditioner. Moreover, the axial piston drive can be operated with low pressure in the crank chamber. A leakage flow of coolant from the crank chamber and outward through shaft seals is approximately proportional to the pressure in the crank chamber. By keeping the pressure low, an elaborate sealing of the crank chamber can be eliminated and the leakage current made smaller. This is advantageous in particular in the case of coolants with high absolute pressures, for which in general high pressures in the crank chamber are needed to achieve control by way of a gas-pressure difference at the piston. With a low pressure, furthermore, the coolant of an air conditioner is only slightly soluble in a lubricant of the condenser, as a result of which a high viscosity can be maintained.

Another way in which a separate adjustment unit has a positive effect on viscosity is that heating of the lubricant by gas that has been warmed by the high-pressure side of the piston can be avoided. With a high viscosity, low friction between heavily loaded pairs of sliding elements on the swash plate and between the pistons and the cylinders can be achieved, which contributes to a long working life and a high degree of reliability.

With an adjustment unit separate from the piston, no particular pressure in the crank chamber is needed for control, as a result of which coolant can be conducted from an evaporator through the crank chamber into the cylinder. Therefore the crank chamber can be cooled, an additional suction chamber on the upper side of the piston can be avoided, and hence the whole structure occupies less space.

Furthermore, it is usually possible to utilize a large volume of the crank chamber for the attenuation of gas pulsations.

The adjustment unit can be driven electrically, pneumatically or preferably hydraulically. With hydraulic fluid an advantageous damping of oscillation can be achieved and a particularly vibration-insensitive axial piston drive created. The hydraulic adjustment unit can be supplied with compressed oil by a hydraulic unit that is independent of the medium being propelled by the piston; for example, a hydraulic unit that is already present in a motor vehicle can advantageously be used for this purpose. Additional components can then be eliminated and a large range of control, independent of the operating points of the axial piston drive, can be attained. Furthermore, no build-up of pressure is needed for control when the axial piston drive is started up, for instance through a minimal tilt angle of 2°. A load-free starting of the axial piston drive is made possible, and it becomes easier to start devices such as an internal combustion engine that powers the axial piston drive.

With an oil trap connected downstream of the condenser, good heat transfer into the heat exchanger can be ensured and a high efficiency of an air conditioner achieved. Furthermore, the oil trap can be put to particularly good use if it supplies the hydraulic adjustment unit with compressed oil. Pressure is applied to the oil from the oil trap to an extent that depends on the operating point. If a large controlling torgue is required, the pressure in the oil trap is high; if only a small controlling torgue is needed, the pressure there is low.

In one embodiment it is proposed to connect the hydraulic adjustment unit to the crank chamber by way of a drain, which is a particularly useful arrangement in that the oil trap and the adjustment unit can be used to transport the lubricant back into the crank chamber. In this process, a influx from the oil trap to the adjustment unit and/or the drain from the adjustment unit to the crank chamber can be made controllable. If only the drain or the influx is designed to be controllable, whichever of these is not controlled can incorporate an inexpensive throttling site.

In the case in which only the drain or the influx can be controlled, it may happen that more lubricant is separated out in the oil separator than is needed for the adjustment unit or for the control. To ensure that the amount of lubricant in the crank chamber is always appropriate, in one embodiment it is proposed that there be disposed in the oil separator and/or in the crank chamber at least part of an oil-level controller which, when an oil level in the oil separator is exceeded and/or the oil in the crank chamber falls below a certain level, connects the oil separator to the crank chamber by way of a channel. It is further possible for the oil separator to be permanently connected to the crank chamber by a channel and a throttling site, or the oil separator and the amount of oil coordinate with respect to one another in such a way that the oil separator overflows before an oil or lubricant deficiency develops in the crank chamber. The overflowing oil can subsequently be sent into the crank chamber, for example together with a coolant for an air conditioner. With a controlled influx and a controlled drain, it can be ensured that the crank chamber always contains an adequate amount of lubricant.

The swash plate can be constructed so as to be tiltable and axially displaceable in various ways, as seems appropriate to a person skilled in the art. For example, the swash plate can be supported on a Z shaft with a tilted bore of bearing, and a stroke movement can be superimposed by a rotational movement of the bearing disk, and so on. In one embodiment of the invention it is proposed that the swash plate be supported on a joint head that can be axially displaced by means of a setting piston incorporated in the adjustment unit, and that the swash plate also be connected by way of an off-centre joint to a component that is fixed in the axial direction. A structurally simpler and more economical displacement mechanism can thus be achieved, in which the tilt angle and axial position of the swash plate are related to one another in a specified manner. The top-dead-centre point of the piston within the cylinder can be maintained and it becomes possible to avoid a damage space and energy losses, as a result of which the axial piston drive can be used particularly advantageously as a condenser in an air conditioner. The condenser can be designed as a pure swash-plate condenser or as a wobble-plate condenser. Furthermore, the solution in accordance with the invention can be employed with gear mechanisms and the like.

It is advantageous to construct the setting piston and the joint head in one piece, which can provide a saving in extra components as well as the effort of assembly and expense. The adjustment unit can be so disposed that it either rotates with the drive shaft, partially or completely, or is unrotatably fixed within a housing. Furthermore, the adjustment unit can act on the swash plate either from the side away from the piston or from the side facing the piston.

DRAWING

Additional advantages will be apparent from the following description of drawings that show exemplary embodiments of the invention. The drawings, the description and the claims contain numerous characteristics in combination. A person skilled in the art will be able also to consider the characteristics individually and to assemble them into other useful combinations.

Figure 2:
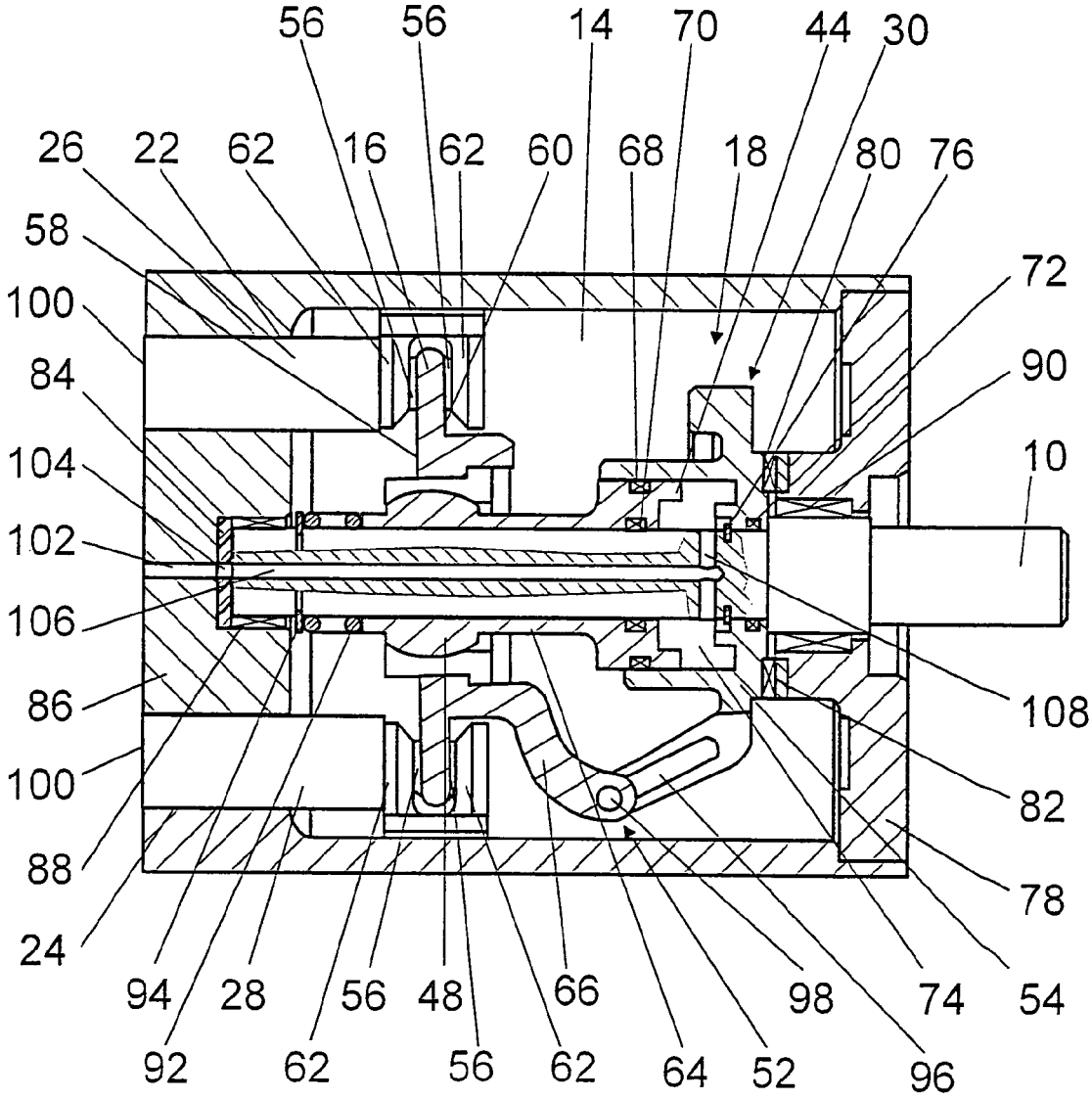
Figure 3:
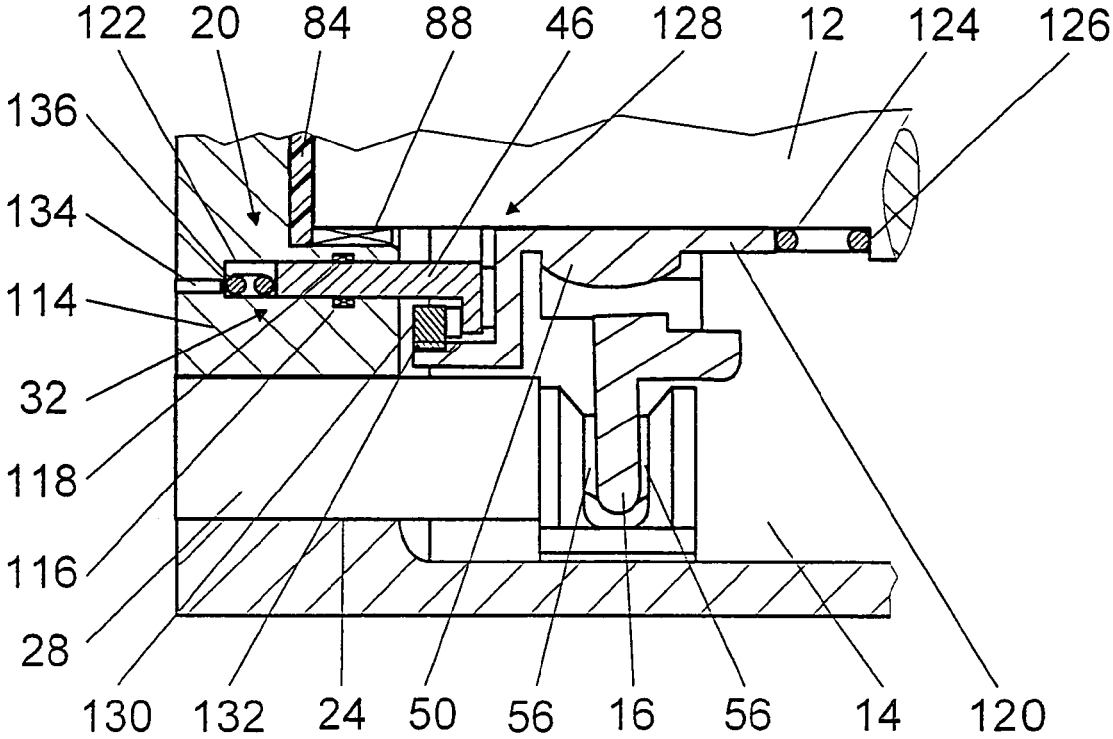
Figure 4:
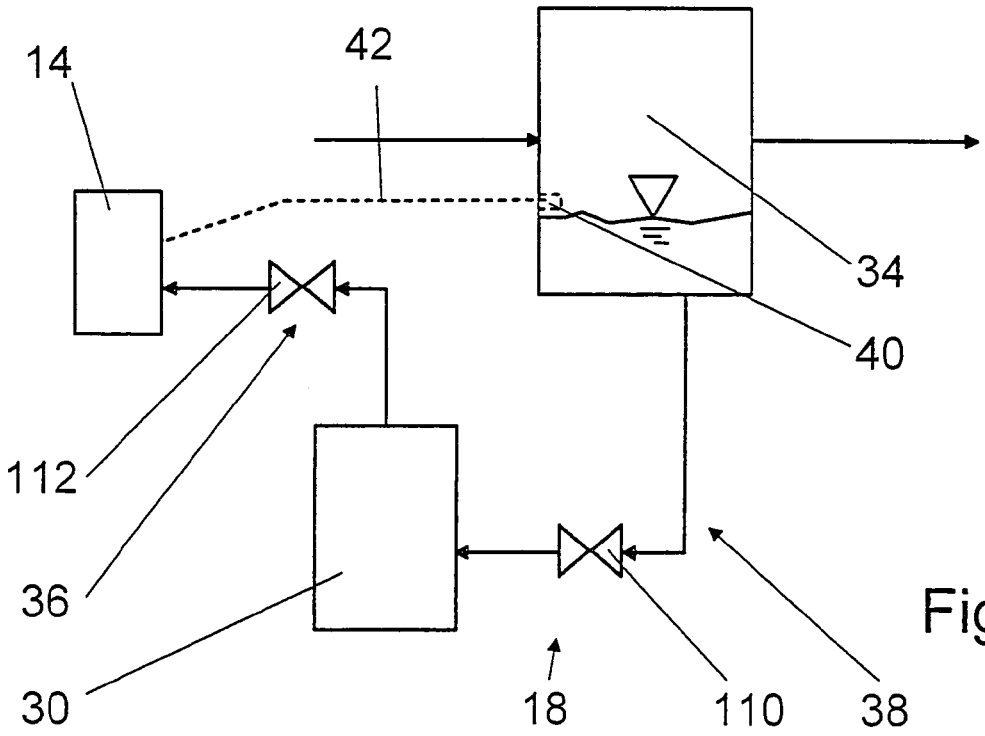

The individual figures show the following:

FIG. 1 an axial piston drive with the piston at the maximal end of its stroke, in section, FIG. 2 an axial piston drive with the piston at the minimal end of its stroke, in section, FIG. 3 part of a variant according to FIG. 1, and FIG. 4 a schematic diagram of a form of hydraulic control.

DESCRIPTION OF THE EXEMPLARY EMBODIMENTS

FIG. 1 shows an axial piston drive for an air conditioner of a motor vehicle, which operates as a condenser. The axial piston drive comprises a drive shaft 10 on which a swash plate 16 is supported within a crank chamber 14. The driving action of the swash plate 16 is exerted by way of hemispherical hinge yokes 56, which connect it to pistons 26, 28 that are guided within cylinders 22, 24. To absorb tractive and pressure loads, each piston 26, 28 is connected to the swash plate 16 by way of two hinge yokes 56, one of which contacts the bearing face 58 that faces away from the pistons 26, 28 while the other contacts the bearing Face 60 that faces towards the pistons 26, 28. The hinge yokes 56 run, by way of their flat surfaces, along the bearing faces 58, 60 of the swash plate 16 at the full circumferential velocity with superimposed radial movement, as a result of which an elliptical track is produced. The rounded surfaces of the hinge yokes 56 are seated in sphere shaped formed bearings 62 of the pistons 26, 28, within which there is comparatively little relative movement during operation.

The swash plate is connected to the drive shaft 10 in a unrotatably fixed manner, by way of a joint head 48 of a sleeve 64. So that the piston stroke and hence the ouput of the axial piston drive can be continuously adjusted, the swash plate 16 is made so that it can be tilted on the joint head 48 by means of a controller 18 and moved in the axial direction along with the sleeve 64. When the tilt angle is large, a long piston stroke and a high output are achieved, while with a small tilt angle the piston stroke is short and the output low (FIGS. 1 and 2).

In accordance with the invention the controller 18 comprises a hydraulic adjustment unit 30 that is separate from the pistons 26, 28. The adjustment unit 30 incorporates a setting piston 44 formed in one piece with the sleeve 64 and the joint head 48. The setting piston 44 is guided within a cylinder formed by an adjustor housing 54. The adjustor housing 54 is attached to the drive shaft 10 in a form-fitting manner, in the radial direction by way of a fitting means not shown here, and axially by way of a tension ring 76. The drive shaft 10 is axially supported in the direction away from the cylinders 22, 24 by the adjustor housing 54, an axial bearing 80 and a running plate 82 set into a cover 78; in the direction towards the cylinders 22, 24 it rests against a housing 86 of the axial piston drive by way of an axial slide bearing 84. The drive shaft 10 is additionally supported in the cover 78 and in the housing 86 by way of two radial bearings 88, 90.

The setting piston 44, together with the cylinder, encloses a pressure space 74 that is sealed off by three seals 68, 70, 72. The swash plate 16 is connected to the adjustor housing 54 by way of a joining element 66, which is formed integrally with the swash plate 16, and by an off-centre joint 52.

When compressed oil enters the pressure space 74, the setting piston 44 is displaced, together with the sleeve 64, the joint head 48 and the swash plate 16, in the direction towards the cylinders 22, 24, against a prestressed pressure spring 92 (FIG. 2). The pressure spring 92 is nonrotatably attached to the drive shaft 10 and is braced against a tension ring 94 in the direction away from the setting piston 44. By the off-centre joint 52, formed by a bolt 98 that is fixed to the joining element 66 and is guided within a slot 96, the stroke movement of the swash plate 16 causes a moment of tilt acting on the swash plate 16. Upon the stroke movement of the swash plate 16 is superimposed a tilting movement, guided by the bolt 98 in the slot 96, so that in all cases a top-dead-centre point 100 of the piston 26, 28 within the cylinders 22, 24 is preserved. So that only a small amount of oil is required, the volume of the pressure space 74 is preferably small.

The adjustment unit 30, specifically the setting piston 44, is supplied with compressed oil from an oil separator disposed downstream of the cylinders 22, 24, by way of an axial bore 102, 104, 106 in the housing 86, in the slide bearing 84, and in the drive shaft 10, and by way of a radial bore 108 in the drive shaft 10 (FIGS. 1, 2 and 4). The compressed oil is advantageously fed into the drive shaft 10 axially, in the middle. In this region the relative movement between the drive shaft 10 and the slide bearing 84 is advantageously made small. Furthermore, the slide bearing 84 can additionally be used as a seal. If no oil pressure has yet developed in the oil separator 34 when the mechanism is first started, the pressure spring 92 sets the tilt angle to maximal, which ensures a build-up of pressure.

The adjustment unit 30 is connected to the oil separator 34 by a influx 38 and to the crank chamber 14 by a drain 36. The influx 38 and drain 36 can each be controlled by a valve 110, 112. If a higher controlling torgue is needed, the valve 110 opens. The oil flows at a higher pressure level into the adjustment unit 30 and acts on the setting piston 44. The valve 112 remains closed during this process. If a smaller controlling torgue is needed, the valve 112 opens, allowing the oil to flow out of the adjustment unit 30 and making less force available in the adjustment unit 30. The swash plate 16 is displaced by the pressure spring 92 in the direction towards the maximal tilt angle. The valve 110 is closed.

If one of the valves 110, 112 is replaced by a throttle, so that only the influx 38 or the drain 36 can be controlled, there can advantageously be provided an oil-level controller 40 and a channel 42 from the oil separator 34 to the crank space 14, as indicated in FIG. 4, to ensure that an adequate amount of lubricant is always available in the crank space 14.

FIG. 3 shows part of a variant of an axial piston drive with a controller 20. Components that are substantially the same are in general identified by the same reference numerals. Regarding the function and components not shown here, reference is made to the exemplary embodiment in FIGS. 1 and 2. The controller 20 comprises an adjustment unit 32 with a setting piston 46 that is nonrotatably disposed in an annular recess 122 in a housing 114 of the axial piston drive. This arrangement makes an additional adjustor housing unnecessary. The setting piston 46 is loaded in the direction towards the swash plate 16 by a first compression spring 136, is sealed off from the housing 114 by two seals 116, 118 and acts on the swash plate 16 in the axial direction, by way of a sleeve 120 and a joint head 50 formed integrally with the sleeve 120, against a second prestressed, stronger pressure spring 124. In the direction away from the setting piston 46 the spring 124 is braced against a shoulder 126 of a drive shaft 12. The swash plate 16 is braced in the axial direction by an off-centre joint (not shown here), so that the stroke movement of the swash plate 16 exerts a moment of tilt on the swash plate 16. The setting piston 46 and the sleeve 120 are connected to one another by an axial bearing 128 that acts on both sides, such that the setting piston 46 forms inner bearing faces whereas the sleeve 120 and a fastening element 130 form outer bearing faces. With the fastening element 130, which is connected to the sleeve 120 by a screw thread 132, the degree of axial play in the axial bearing 128 can be set to a specified value. The adjustment unit 32, i.e. the setting piston 46, is supplied with compressed oil from an oil separator 34 by way of an axial bore 134, as is the adjustment unit 30 (cf. relevant part of FIG. 4).

LIST OF REFERENCE NUMERALS

10 Drive shaft
12 Drive shaft
14 Crank space
16 Swash plate
18 Controller
20 Controller
22 Cylinder
24 Cylinder
26 Piston
28 Piston
30 Adjustment unit
32 Adjustment unit
34 Oil spearator
36 Drain
38 Influx
40 Oil-level controller
42 Channel
44 Setting piston
46 Setting piston
48 Joint head
50 Joint head

52 Joint
54 Component
56 Hinge yoke
58 Bearing face
60 Bearing face
62 Bearing
64 Joint sleeve
66 Joining element
68 Seal
70 Seal
72 Seal
74 Pressure space
76 Tension ring
78 Cover
80 Axial bearing
82 Thrust washers
84 Slide bearing
86 Housing
88 Bearing
90 Bearing
92 Pressure spring
94 Tension ring
96 Slot
98 Bolt
100 Top-dead-centre
102 Bore
104 Bore
106 Bore
108 Bore
110 Valve
112 Valve
114 Housing
116 Seal
118 Seal
120 Joint sleeve
122 Recess
124 Pressure spring
126 Shoulder
128 Bearing
130 Fastening element
132 Screw thread
134 Bore
136 Pressure spring

What is claimed is:

1. Axial piston drive with a continuously adjustable piston stroke, comprising a drive shaft (10, 12) on which a swash plate (16) is supported in a crank chamber (14) in such a way as to be tiltable and displaceable in the axial direction, and with a controller (18, 20) by means of which an tilt angle and an axial position of the swash plate (16) can be adjusted, and with at least one piston (26, 28) connected to the swash plate (16) so that it can be actuated to move within the cylinder (22, 24), wherein the controller (18, 20) incorporates an adjustment unit (30, 32) that is separated from the piston (26, 28) and hydraulically driven, characterized in that the adjustment unit (30, 32) is supplied with compressed oil by a hydraulic unit which is controlled independently of the medium being propelled by the piston (26, 28), the hydraulic unit comprises an oil separator (34) disposed downstream of the cylinder (22,24).

2. Axial piston drive according to claim 1, characterized in that the hydraulic adjustment unit (30, 32) is connected to the crank chamber (14) by way of a drain (36), and a influx (38) from the oil separator (34) to the adjustment unit (30, 32) or the drain (36) from the adjustment unit (30, 32) to the crank chamber (14) can be controlled.

3. Axial piston drive according to claim 1, characterized in that in the oil separator (34) and/or in the crank chamber (14) at least part of an oil-level controller (40) is disposed which, when a specified oil level in the oil separator (34) is exceeded and/or when the oil in the crank chamber (14) falls below a certain level, connects the oil separator (34) to the crank chamber (14) by way of a channel (42).

4. Axial piston drive according to claim 1, characterized in that in the oil separator and an amount of oil that is present are matched to one another in such a way that before an oil deficiency appears in the crank chamber (14), the oil separator overflows and the overflowing oil flows back into the crank chamber (14).

5. Axial piston drive according to claim 1, characterized in that in the adjustment unit (30, 32) is connected to the crank chamber (14) by way of a drain (36), and a influx (38) from the oil separator (34) to the adjustment unit (30, 32) and the drain (36) from the adjustment unit (30, 32) to the crank chamber (14) can be controlled.

6. Axial piston drive according to claim 1, characterized in that the swash plate (16) is supported on a joint head (48, 50) that can be axially displaced by means of a setting piston (44, 46) of the hydraulic adjustment unit (30, 32) and the swash plate (16) is connected by an off-centre joint (52) to a component (54) that is fixed in the axial direction.

7. Axial piston drive according to claim 6, characterized in that in the setting piston (44) and the joint head (48) are constructed in one piece.

8. Axial piston drive with a continuously adjustable piston stroke, comprising a drive shaft (10, 12) on which a swash plate (16) is supported in a crank chamber (14) in such a way as to be tiltable and displaceable in the axial direction, and with a controller (18, 20) by means of which an tilt angle and an axial position of the swash plate (16) can be adjusted, and with at least one piston (26, 28) connected to the swash plate (16) so that it can be actuated to move within a cylinder (22, 24), wherein the controller (18, 20) incorporates an adjustment unit (30, 32) that is separated from the piston (26, 28) and hydraulically driven, characterized in that the adjustment unit (30, 32) is supplied with compressed oil by an oil separator (34) disposed downstream of the cylinder (22, 24) and is connected to the crank chamber (14) by way of a drain (36), and a influx (38) from the oil separator (34) to the adjustment unit (30, 32) or the drain (36) from the adjustment unit (30, 32) to the crank chamber (14) can be controlled.

9. Axial piston according to claim 8 characterized in that in the oil separator (34) and/or in the crank chamber (14) at least part of an oil-level controller (40) is disposed which, when a specified oil level in the oil separator (34) is exceeded and/or when the oil in the crank chamber (14) falls below a certain level, connects the oil separator (34) to the crank chamber (14) by way of a channel (42).

10. Axial piston according to claim 8 characterized in that in the oil separator and an amount of oil that is present are matched to one another in such a way that before an oil deficiency appears in the crank chamber (14), the oil separator overflows and the overflowing oil flows back into the crank chamber (14).

11. Axial piston according to claim 8 characterized in that in the adjustment unit (30, 32) is connected to the crank chamber (14) by way of a drain (36), and a influx (38) from the oil separator (34) to the adjustment unit (30, 32) and the drain (36) from the adjustment unit (30, 32) to the crank chamber (14) can be controlled.

* * * * *